US005624251A

United States Patent [19]

Negrini et al.

[11] Patent Number: 5,624,251

[45] Date of Patent: Apr. 29, 1997

[54] GEAR PUMP

[75] Inventors: Stefano Negrini, Sala Baganza; Umberto Verza, Reggio Emilia, both of Italy

[73] Assignee: Casappa S.p.A., Cavalli Di Collecchio, Italy

[21] Appl. No.: 499,612

[22] Filed: Jul. 7, 1995

[30] Foreign Application Priority Data

Jul. 14, 1994 [IT] Italy ..... PR94A0029
Jan. 31, 1995 [IT] Italy ..... PR95A0005

[51] Int. Cl.[6] ..... F01C 1/18

[52] U.S. Cl. ..... 418/206.1

[58] Field of Search ..... 418/206.1, 206.6, 418/206.7

[56] References Cited

U.S. PATENT DOCUMENTS 1,783,209 12/1930 Wilsey .
3,995,975 12/1976 Bosch ..... 418/206.6
4,682,938 7/1987 Riordan ..... 418/206.7
4,909,714 3/1990 Cheng .

FOREIGN PATENT DOCUMENTS 452620 10/1943 Belgium .
0534836 3/1993 European Pat. Off. .
1302179 12/1962 France .
2266014 10/1975 France .
965470 7/1964 United Kingdom .

*Primary Examiner*—Charles G. Freay
*Attorney, Agent, or Firm*—Dvorak and Traub

[57] ABSTRACT

Problematic noise levels in a hydraulic gear pump are overcome by exerting a radial force on the two shafts with which the gears are associated. The force has a direction and a strength that will combine with the resultant of the pressure forces and gear tooth contact forces, thereby eliminating backlash between the teeth. The system can be mechanical or hydraulic, and is incorporated either into the pump body or into pressure-balanced bearing blocks.

5 Claims, 5 Drawing Sheets

GEAR PUMP

BACKGROUND OF THE INVENTION

The present invention relates to a gear pump. Conventional hydraulic gear pumps consist typically in a casing, of which the interior is fashioned with two intercommunicating cylindrical chambers, and accommodated internally of the chambers, two toothed wheels or gears engaged in constant mesh. One such gear is integral with or keyed to a drive shaft supported in the pump casing and projecting at one end to allow of being coupled to a power source, whilst the remaining gear is integral with or keyed to a driven shaft, likewise supported in the casing.

One of the cylindrical chambers is connected to an inlet pipeline through which oil will be drawn from a tank, and the remaining chamber is connected to a pressure pipeline.

Oil from the tank is trapped by the meshing teeth of the gears and forced into the pressure pipeline, according to a principle already familiar to those skilled in the art.

The casing of the pump is composed of a central body, and two end covers between which the central body is sandwiched and bolted.

Pressure-loaded bearing blocks may also be located between the two covers and the body of the pump, affording bores to accommodate the two shafts. One particularly noticeable problem experienced with this type of pump is the noise generated by the meshing action of the gears in trapping the oil and transferring the flow from the inlet pipeline to the pressure pipeline.

To ensure that the pump will deliver an acceptable level of efficiency in combination with a low level of noise, each tooth of the driving gear must make contact on both flanks with the teeth of the driven gear.

This is a question that tends, within the scope of the prior art, to be addressed by the adoption of purely geometrical solutions, aimed at optimizing tooth profiles and manufacturing tolerances; the problem can indeed be overcome in this way, albeit incurring considerable extra production costs.

In many instances, manufacturing tolerances will be such as to disallow any effective and repeatable solution to the problem.

The prior art also embraces the notion of splitting each gear into two parts exhibiting sets of teeth staggered one from the other.

Such a technique likewise overcomes the problem in question, though the costs of realization are high. The object of the present invention is to overcome the aforementioned noise problem by modifying the resultant of the forces acting on the driven shaft and the drive shaft (namely, the pressure forces on the gears, and the forces generated by gear tooth contact), through the application of a force either to the bearing block or directly to the shaft.

SUMMARY OF THE INVENTION

The stated object is realized in a pump according to the present invention, of which the essential feature is that it comprises means located within the body and designed to bear against the shafts with a force of direction and strength such as will combine with the resultant of the pressure forces and gear tooth contact forces to eliminate backlash between the meshing teeth.

In one possible embodiment of a pump according to the invention, each bearing block is divided into two halves located side by side in a relative seat, and each half block associated with means by which the respective gear shaft is subjected ultimately to a radial force of direction and strength such as will combine with the resultant of the pressure and gear tooth contact forces to eliminate backlash.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
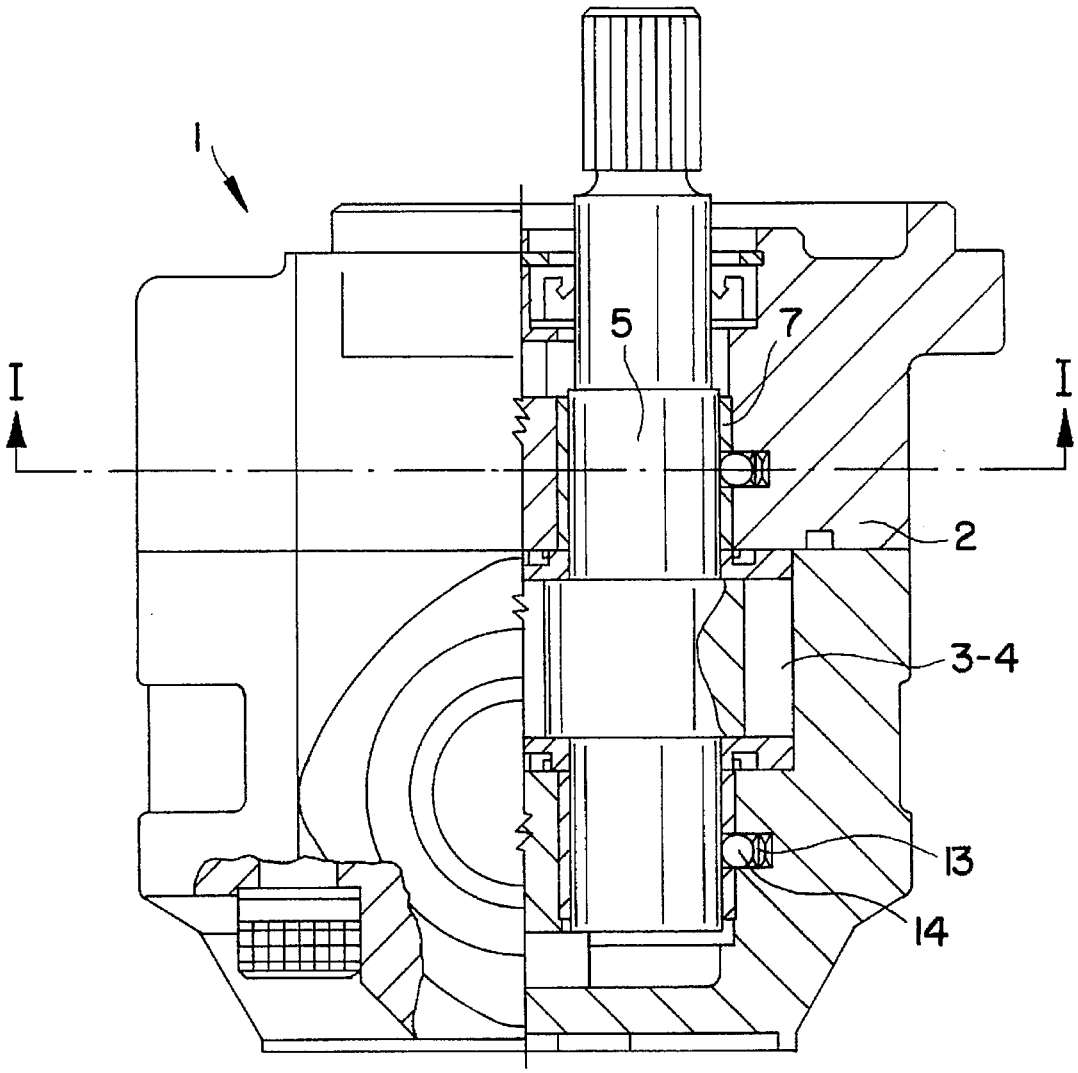
FIG. 1 illustrates a gear pump viewed in a frontal elevation, partly in section, and incorporating a first possible embodiment of the invention.
Figure 2:
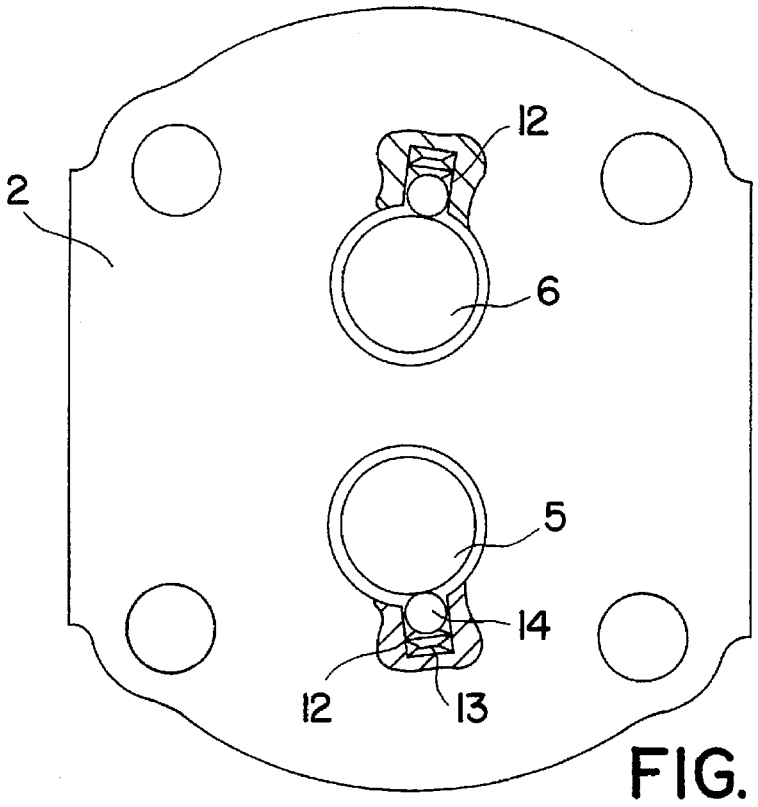
FIG. 2 illustrates the pump of FIG. 1 in a section through I—I.

With reference to FIG. 1 and FIG. 2 of the drawings, 1 denotes a gear pump of which the function is to direct oil under pressure to a hydraulic service such as a motor or a cylinder.

The gear pump 1 comprises a casing composed of a central body 2 and, bolted to the body, two end covers of conventional embodiment not illustrated in the drawings.

The pump body affords two cylindrical bores housing two gears 3 and 4 in constant mesh, of which one is associated with a drive shaft 5 projecting from the casing, and the other with a driven shaft 6 housed entirely within the body and the two bolted covers. Both shafts 5 and 6 are carried by bearings 7 set into the pump body.

The body 2 of the pump exhibits two radial holes 12 communicating with the shafts 5 and 6 and serving to accommodate at least one belleville spring 13 and a ball 14.

The belleville springs 13 and the ball 14 provide means by which to exert a mechanical force on the relative shaft.

The ball 14 is caused by the belleville springs 13 to bear against the shaft in a direction such as will introduce a force generated in addition to the gear tooth contact and pressure forces and designed to modify their effect.

Figure 3:
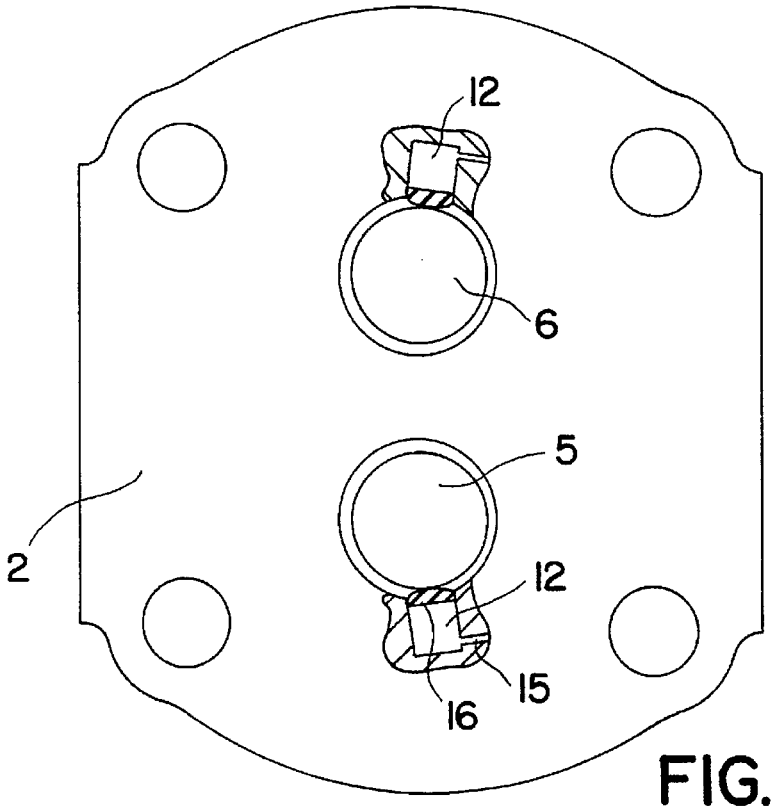
FIG. 3 shows a gear pump as in FIG. 1 in a section similar to that of FIG. 2, incorporating a second possible embodiment of the invention.

In the example of FIG. 3, the additional force is applied by the pressure of oil directed into the radial hole 12 through a connecting passage 15. More exactly, the oil impinges on a plunger 16, capable of translational movement along the radial hole 12, in such a way that the plunger 16 is made to bear radially against the cylindrical surface of the shaft.

Figure 4:
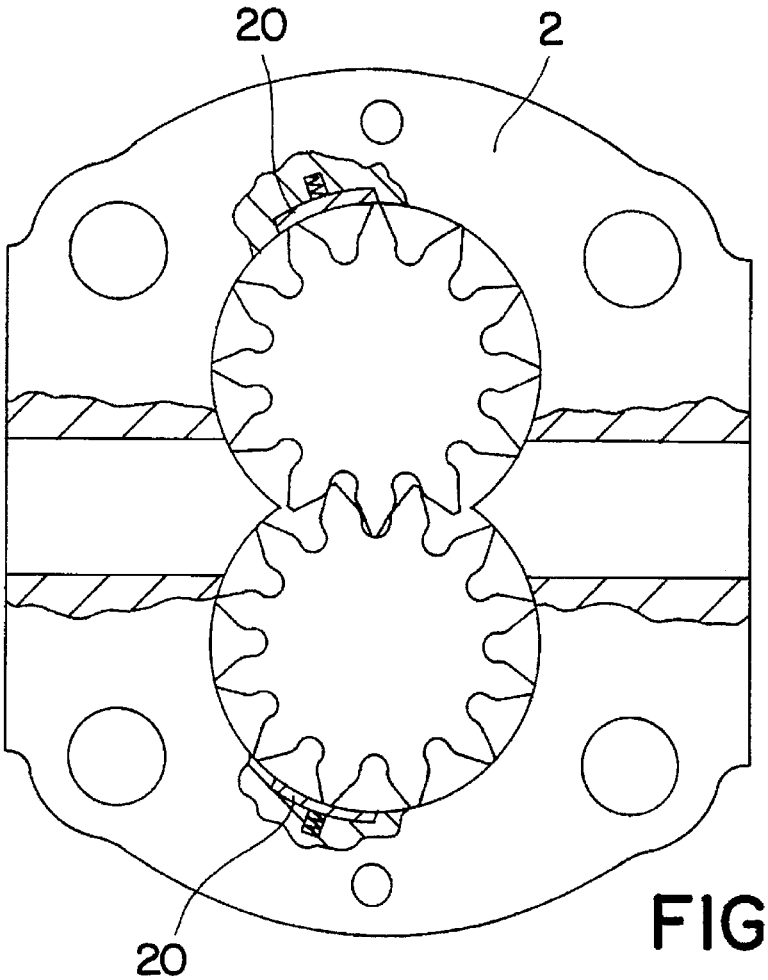
FIG. 4 illustrates a gear pump viewed in a cross section taken through the gears and incorporating a third possible embodiment of the invention.
Figure 5:
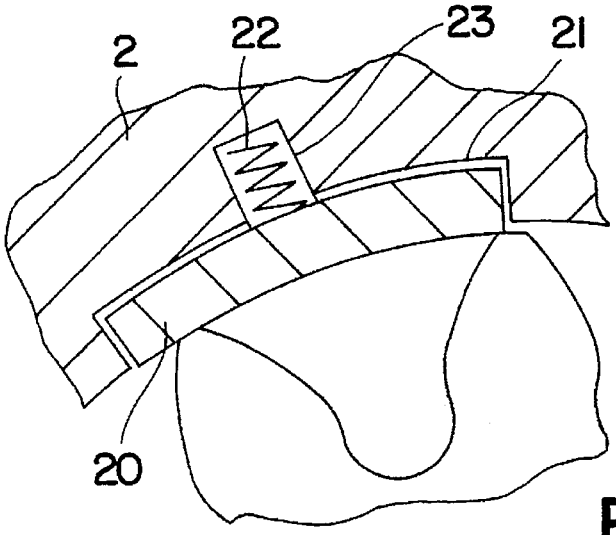
FIG. 5 is the enlarged view of a detail of FIG. 4.

FIGS. 4 and 5 illustrate another possible embodiment of the means disclosed, in this instance comprising a shoe 20 accommodated internally of a respective recess 21 created in the part of the pump body 2 housing the gears, which is caused to bear against the corresponding gear by the action of a spring 22 seated in a hole 23 behind the recess 21.

The shoe 20 compasses an arc of length such as will ensure that its arcuate surface remains in contact with the tips of at least two teeth at any time. In the examples illustrated thus far, the various means designed to bear against the relative shaft or gear and exert a force having the aforementioned characteristics are mounted in the body 2 of the pump, though in a further possible embodiment not shown in the drawings, these same means might also be located in the two covers and positioned to act directly on the extremities of the shafts 5 and 6. In another embodiment of the invention, intended for a pump of the type having pressure-balanced bearing blocks, the force in question is exerted by way of the bearings.

Figure 6:
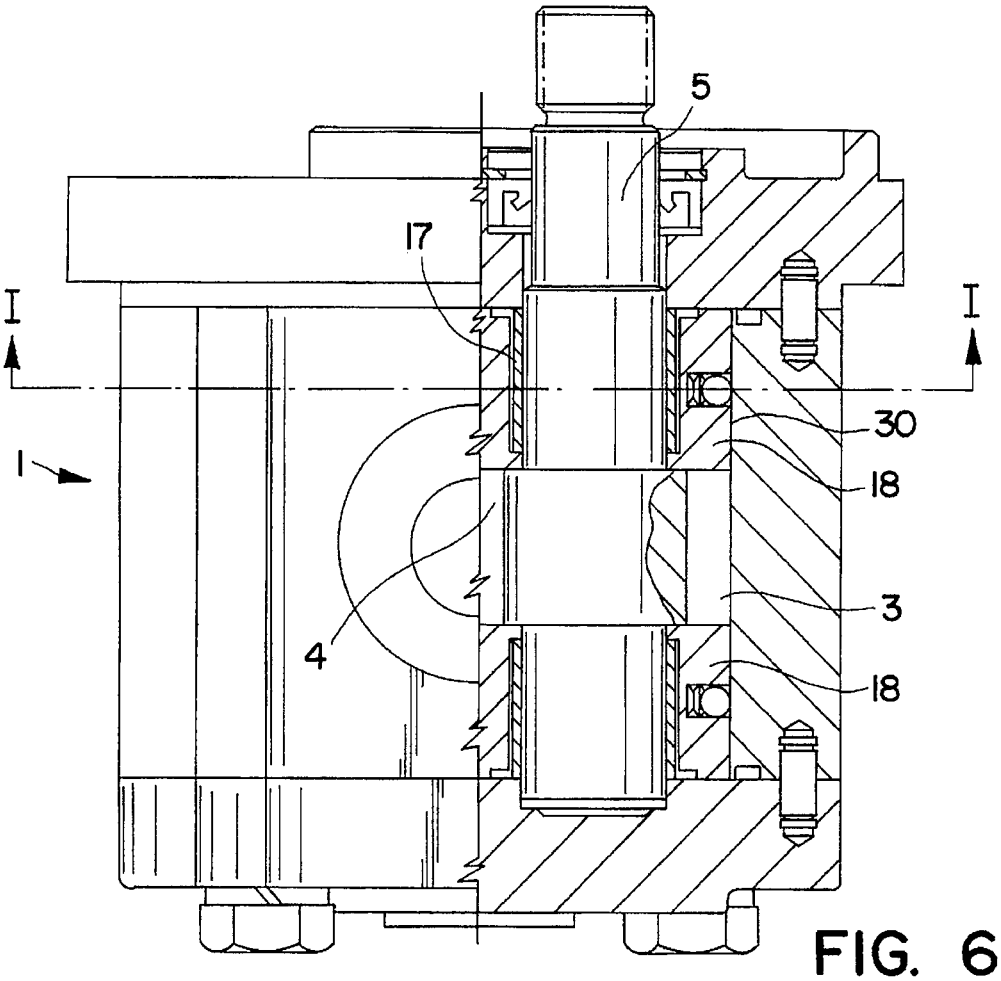
FIG. 6 illustrates a gear pump different to that of FIG. 1, viewed in a longitudinal section.
Figure 7:
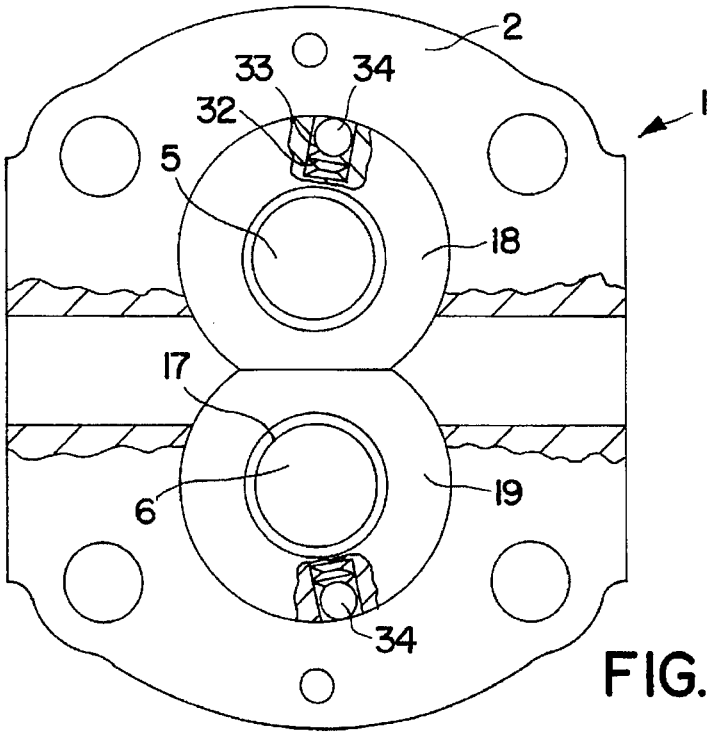
FIG. 7 illustrates the pump of FIG. 6 in a section through I—I.
Figure 8:
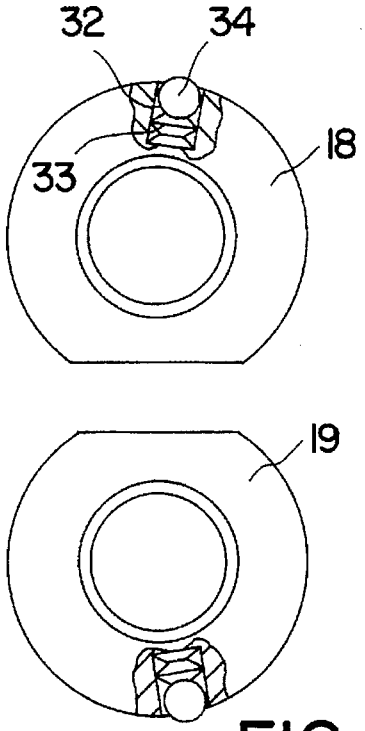
FIG. 8 illustrates a bearing block embodied in two distinct halves.

Referring to FIGS. 6, 7 and 8, both shafts 5 and 6 are supported by bushings 17 inserted into bearing blocks which in this instance are embodied in two halves; more exactly, the driving shaft 5 turns in two half blocks denoted 18, and the driven shaft 6 in two half blocks denoted 19.

The pairs of half blocks 18 and 19 are housed with a certain degree of clearance in relative seats 30 afforded by the pump body, the two halves of each pair being entirely independent, with no connecting element.

Each half block 18 and 19 affords a radial hole 32, accommodating at least one belleville spring 33 and a ball 34, and positioned such that the ball 34 is forced by the belleville springs against the wall of the seat 30 in which the block is housed.

The orientation of the radial hole 32 is such that the force generated by the belleville springs in the half bearing block will offset the pressure and gear tooth contact forces, modifying their effect in consequence.

More exactly, the effect of the force generated through the half bearing block is to redirect the resultant of the pressure and gear tooth contact forces in such a way that the two gears are brought closer together and backlash between the teeth is eliminated.

The orientation of the radial hole 32 can vary within an arc of plus or minus 60° in relation to the median axis of the pump.

Figure 9:
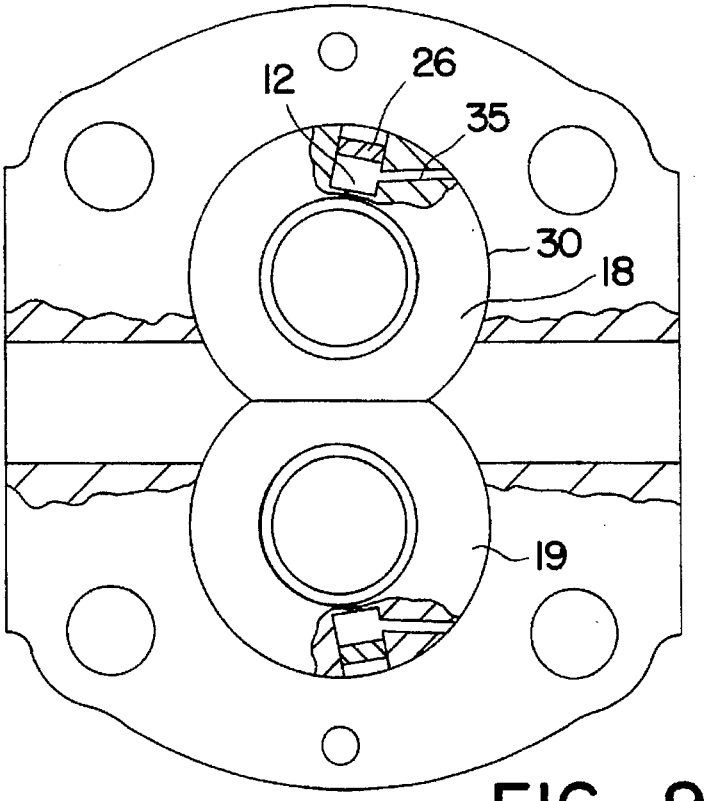
FIG. 9 illustrates the pump of FIG. 6 in a section similar to that of FIG. 7, incorporating a further possible embodiment of the invention.

Whilst reference is made specifically to a force generated by springs in the solution of FIGS. 6, 7 and 8, the selfsame force clearly might be produced by other suitable means, for example hydraulically as illustrated in FIG. 9.

In this instance, the radial hole 32 communicates with a source of high pressure by way of a relative connecting passage 35.

The oil pressure impinges on a small piston 26, as a result of which the piston is forced along the radial hole 32 and into contact with the wall of the seat 30 in which the bearing block 18 and 19 is accommodated.

In a further possible embodiment of the invention (not illustrated), the elastically or hydraulically generated force might be applied actively to the pressure-balanced bearing blocks, when these are divided into two halves as described above, rather than reactively as in the drawings.

All the solutions described above will realize the stated object of eliminating backlash between the teeth of a gear pump, with the consequent advantage that operating noise levels are lowered.

What is claimed:

1. A gear pump, comprising:

a casing that consists in a body enclosed by two covers and having two parallel cylindrical bores;

two gears accommodated rotatably in the parallel bores, engaged in constant mesh and associated rigidly with respective shafts supported rotatably by bushings located in corresponding seats afforded by the body;

means housed in the body of the pump casing and designed to exert a force on the shaft associated with each gear, of a direction and a strength such as will combine with the resultant of the pressure forces and gear tooth contact forces to eliminate backlash between the teeth of the gears wherein said means housed in the body of the pump affords a radial hole accommodating a spring impinging on a ball compassed substantially in its entirety by the radial hole and positioned to bear directly against the shaft of a corresponding gear.

2. A gear pump as in claim 1, wherein the body of the pump affords a recess located in the part of the bore occupied by the gear and accommodating an arcuate element constrained elastically to bear against the gear.

3. A gear pump, comprising:

a casing that consists in a body enclosed by two covers and having two parallel cylindrical bores;

two gears accommodated rotatably in the parallel bores, engaged in constant mesh and associated rigidly with respective shafts supported rotatably by bushings located in corresponding seats afforded by the body;

means housed in the body of the pump casing and designed to exert a force on the shaft associated with each gear, of a direction and a strength such as will combine with the resultant of the pressure forces and gear tooth contact forces to eliminate backlash between the teeth of the gears wherein the means housed in the body of the pump casing affords a radial hole pressurized with oil and slidably accommodating a plunger positioned to bear directly against the shaft of a corresponding gear.

4. A gear pump, comprising:

a casing that consists in a body enclosed by two covers and having two parallel cylindrical bores;

two gears accommodated rotatably in the parallel bores, engaged in constant mesh and associated rigidly with respective shafts supported rotatably by bushings set into pressure balanced bearing blocks housed in seats afforded by the body, wherein the bearing blocks are embodied in two halves positioned one beside the other, each of the bearing blocks accommodating means by which to exert a force on the relative shaft of a direction and a strength such as will combine with the resultant of the pressure forces and gear tooth contact forces so as to eliminate backlash between the teeth of the gears, wherein each of the bearing blocks accommodating means comprises a radial hole accommodating a spring impinging on a ball compassed substantially in its entirety by the radial hole and projecting marginally in such a manner as to bear directly against a wall of the seat afforded by the pump casing, in which the bearing block is housed with a given degree of clearance, wherein the spring is a belleville disk.

5. A gear pump, comprising:

a casing that consists in a body enclosed by two covers and having two parallel cylindrical bores;

two gears accommodated rotatably in the parallel bores, engaged in constant mesh and associated rigidly with respective shafts supported rotatably by bushings set into pressure-balanced bearing blocks housed in seats afforded by the body, where the bearing blocks are embodied in two halves positioned one beside the other, each accommodating means by which to exert a force on the relative shaft, of a direction and a strength such as will combine with the resultant of the pressure forces and gear tooth contact forces so as to eliminate backlash between the teeth of the gears, wherein each accommodating means comprises a radial hole slidably accommodating a piston and connected hydraulically to a source of high pressure in such a way that the piston is caused to bear radially against a wall of the seat afforded by the pump casing, in which the bearing block is housed with a given degree of clearance.

* * * * *